US010490179B2

(12) United States Patent
D'Antonio et al.

(10) Patent No.: US 10,490,179 B2
(45) Date of Patent: Nov. 26, 2019

(54) COMBINED DIFFUSER-ABSORBER WITH SPACED SLATS

(71) Applicant: RPG Acoustical Systems LLC, Passaic, NJ (US)

(72) Inventors: Peter D'Antonio, Bowie, MD (US); Jeffrey S. Madison, Wallingford, PA (US)

(73) Assignee: RPG Acoustical Systems, LLC

( * ) Notice: Subject to any disclaimer, the term of this patent is extended or adjusted under 35 U.S.C. 154(b) by 30 days.

(21) Appl. No.: 15/890,549

(22) Filed: Feb. 7, 2018

(65) Prior Publication Data

US 2019/0244596 A1 Aug. 8, 2019

(51) Int. Cl.
*G10K 11/162* (2006.01)

(52) U.S. Cl.
CPC ..... *G10K 11/162* (2013.01)

(58) Field of Classification Search
CPC ..... G10K 11/162
USPC ..... 181/293, 286
See application file for complete search history.

(56) References Cited

U.S. PATENT DOCUMENTS 5,401,921 A * 3/1995 D'Antonio ..... G10K 11/20 181/286
5,817,992 A * 10/1998 D'Antonio ..... E04B 1/8409 181/295
5,969,301 A * 10/1999 Cullum, Jr. ..... E04B 1/86 181/286
9,508,334 B1 * 11/2016 D'Antonio ..... G10K 11/168
2003/0006092 A1 * 1/2003 D'Antonio ..... E04B 1/86 181/293
2004/0060771 A1 * 4/2004 D'Antonio ..... E04B 1/84 181/293
2006/0231331 A1 * 10/2006 D'Antonio ..... E04B 1/86 181/293
2007/0034448 A1 * 2/2007 D'Antonio ..... E04B 1/86 181/293
2014/0291069 A1 * 10/2014 Tizzoni ..... E01F 8/0035 181/293
2014/0339015 A1 * 11/2014 Algargoosh ..... G10K 11/16 181/293

* cited by examiner

*Primary Examiner* — Forrest M Phillips
(74) *Attorney, Agent, or Firm* — H. Jay Spiegel

(57) ABSTRACT

The present invention contemplates regularly spaced or variable width slats having equal width, but with heights determined by an inverted QR sequence, which converts focusing concave areas into beneficial, diffusing convex areas for improved diffusion, especially in the near field. The inverse sequence provides longer resonator necks, between adjacent slats, needed to provide a lower average resonant frequency. Slats are uniformly spaced with inverted QR slat heights have widths determined by the ground states of a Bernesconi sequence. Uniformly spaced, inverted QR slat heights have widths determined by the same QR sequence used to determine heights. Alternatively, uniformly spaced, inverted QR slat heights have widths determined by a Prime 7, primitive root sequence. The uniformly spaced slats have curvilinear forward facing surfaces with their heights based on either a regular or inverted QR sequence, as well as a primitive root or other number theory or optimized sequence.

17 Claims, 13 Drawing Sheets

QRD47

QRD47_Inverse

Figure 16. Illustrates an example of a 3-dimensional topology which can be sliced into a series of spaced, forward facing curvilinear slats.

Predict scattered sound

BEM predictions were verified against numerous experimental measurements as being extremely accurate

Need a metric to evaluate the merit of a shape

The Diffusion Coefficient as described in ISO 17497-2 proved to be an effective metric for uniform scattering Key reason to develop diffusion coefficient

Need an Intelligent Search Engine To Navigate Through All Possible Shapes

There are many robust search engines, we chose the downhill simplex algorithm when derivatives are not known or can use genetic algorithm Analogous to finding lowest valley in mountain range.

COMBINED DIFFUSER-ABSORBER WITH SPACED SLATS

BACKGROUND OF THE INVENTION

Since 1979, it has been known that one-dimensional sound diffusive surfaces, called reflection phase gratings that scatter sound uniformly, can be formed from a series of divided wells or slats, whose depths or heights respectively, are determined according to a variety of optimal number theory sequences. In August 2016, a reference book was published titled "Acoustic Absorbers and Diffusers: Theory, Design and Application," by authors Trevor J. Cox and Peter D'Antonio, CRC Press. In the book, it was suggested that a new type of diffuser consisting of a plurality of equally spaced, parallel rectilinear slats of equal cross-sectional width, but of differing heights, determined according to a number theory sequence, specifically a quadratic residue (QR) sequence, might be used to provide high-mid frequency diffusion and low frequency absorption.

FIG. 1 shows a schematic, side view representation of the slatted diffusing-absorbing device, based on a prime 13, QR sequence, disclosed in the above-mentioned book. No design methodology was provided. However, experimental diffusion coefficient data were presented comparing the performance of a simple prime 7, QR sequence, with a few surfaces having slats of equal height, including a regular arrangement and two irregular arrangements, based on optimal binary sequences.

At the base of the slats, a porous absorbing material is also provided, which adds resistance to the slat resonator formed by the channels between the slats. No description was provided to determine the resonant frequencies of the plurality of slat resonators. The necessity to vary the slat heights to improve dispersion is illustrated in FIG. 2.

The graphs in FIG. 2 show the normalized diffusion coefficient for the devices shown. When the device merely consists of a regularly spaced set of slats of uniform height, then at best a coefficient of 0.2 is achieved (Graph line A). Graph line B shows an irregular arrangement based on an optimal aperiodic sequence. Graph line C shows an irregular arrangement based on a periodic, truncated maximum length sequence. Two examples are shown in Graph lines B & C. While arrangements B and C show improved diffusion, at most the normalized diffusion coefficient is 0.5. However, by varying slat heights, based on a prime 7, QR sequence, the maximum diffusion coefficient is increased to almost 0.7 (Graph line D).

After further research, the present invention teaches the theory and design methodology for a practical device that can be utilized in a wide range of architectural spaces, with primes much larger than 7, which offer an aesthetic, symmetrical topology. In addition, the present invention teaches the theory to determine the resonant frequencies of the spaced slats and a number theory sequence to optimize their bandwidth, both of which are not provided by the brief suggestion made in the published book.

SUMMARY OF THE INVENTION

The present invention relates to a combined diffuser-absorber with spaced slats. The present invention includes the following interrelated objects, aspects and features:

(1) In a first embodiment (FIG. 3), the present invention contemplates regularly spaced slats having equal width, but with heights determined by an inverted QR sequence, which converts focusing concave areas into beneficial, diffusing convex areas for improved diffusion, especially in the near field.

(2) The first embodiment also teaches that the inverse sequence provides longer resonator necks, between adjacent slats, which are needed to provide a lower average resonant frequency, not afforded by the non-inverse diffuser design suggested in the published book.

(3) In a second embodiment (FIG. 4), the uniformly spaced, inverted QR slat heights have widths determined by the ground states of a Bernesconi sequence.

(4) In a third embodiment (FIG. 5), the uniformly spaced, inverted QR slat heights have widths determined by the same QR sequence used to determine the heights.

(5) In a fourth embodiment (FIG. 6), the uniformly spaced, inverted QR slat heights have widths determined by a prime 7, primitive root sequence.

(6) In a fifth embodiment (FIG. 11), the uniformly spaced slats have curvilinear forward facing surfaces with their heights based on either a regular or inverted QR sequence, as well as a primitive root or other number theory or optimized sequence, with their widths determined by any of the options mentioned in FIGS. 3-6.

(7) In a sixth embodiment (FIG. 12), each of the uniformly spaced, equal width slats have a different curvilinearly shaped forward facing surface, the multiplicity of slats combining collectively to form an aesthetically pleasing 3-dimensional optimized shape.

(8) In the preferred embodiments of the present invention, the base of the slats emanates forward of an absorbent material, which may be porous or otherwise designed to achieve sound absorbing capabilities. The maximum slat height is designed in accordance with a number theory or optimized sequence formula to provide a desired design frequency, below which the spaced slats provide low frequency absorption. The greater the maximum slat height, the lower the diffusion cutoff frequency.

(9) The low frequency absorption spectrum of each embodiment of the present invention is determined by the spacing between adjacent slats, the width of the slats, the length of the constrained area between adjacent slats and the depth and contents of the rear cavity containing porous absorbing material.

It is a first object of the present invention to provide a combined diffuser-absorber with spaced slats.

It is a further object of the present invention to provide such a device in which forward facing surfaces of adjacent slats may be planar.

It is a further object of the present invention to provide such a device in which forward facing surfaces of adjacent slats may be non-planar.

It is a further object of the present invention for the spaced curvilinear slats to collectively form a 3-dimensional aesthetically pleasing surface It is a yet further object of the present invention to provide such a device in which the spacing between adjacent slats is the same or different for all adjacent pairs of slats.

It is a yet further object of the present invention to provide such a device in which all slats have equal widths in a direction perpendicular to their direction of extension.

It is a still further object of the present invention to provide such a device in which slats may have varying widths or thicknesses in the direction perpendicular to their respective directions of extension.

It is a still further object of the present invention to provide such a device in which the heights of respective slats are determined through calculation of a number theory sequence.

It is a still further object of the present invention to provide such a device in which the heights of respective slats are determined through an Boundary Element optimization calculation.

It is a still further object of the present invention to provide such a device in which the slat spacing, slat width, the lengths of the resonator necks formed from the constrained areas between adjacent pairs of slats, and rear cavity depth containing a porous absorber form a low frequency slat resonator.

It is a still further object of the present invention to provide the theory and methodology to create the diffuser design.

It is a still further object of the present invention to provide the theory and methodology to design and optimize the topology of the curvilinear slats.

It is a still further object of the present invention to provide the theory and methodology to design an optimized 3-dimensional surface topology, which is formed from the collection of spaced, slat slices of such topology.

It is a still further object of the present invention to provide the theory and methodology to create the low frequency slat resonator design.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
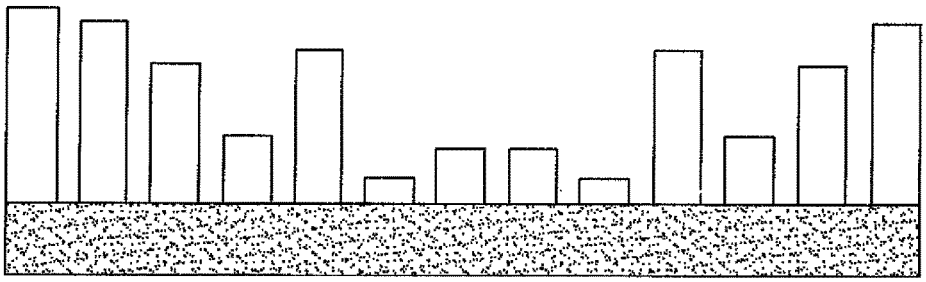
FIG. 1 PRIOR ART
FIG. 1 shows a side view schematic representation of a prior art device including a plurality of adjacent, spaced slats, whose heights are deter tined by a QR sequence.
Figure 2:
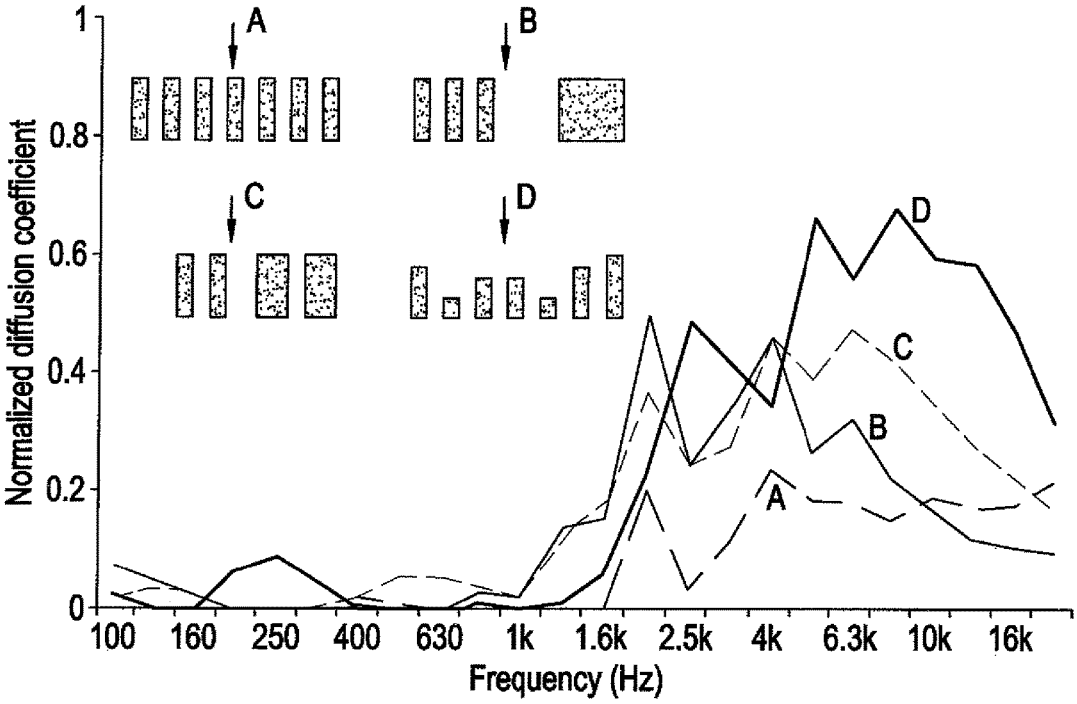
FIG. 2 shows a graph comparing the diffusion coefficient for various diffuser-absorbers as explained earlier.
Figure 3:
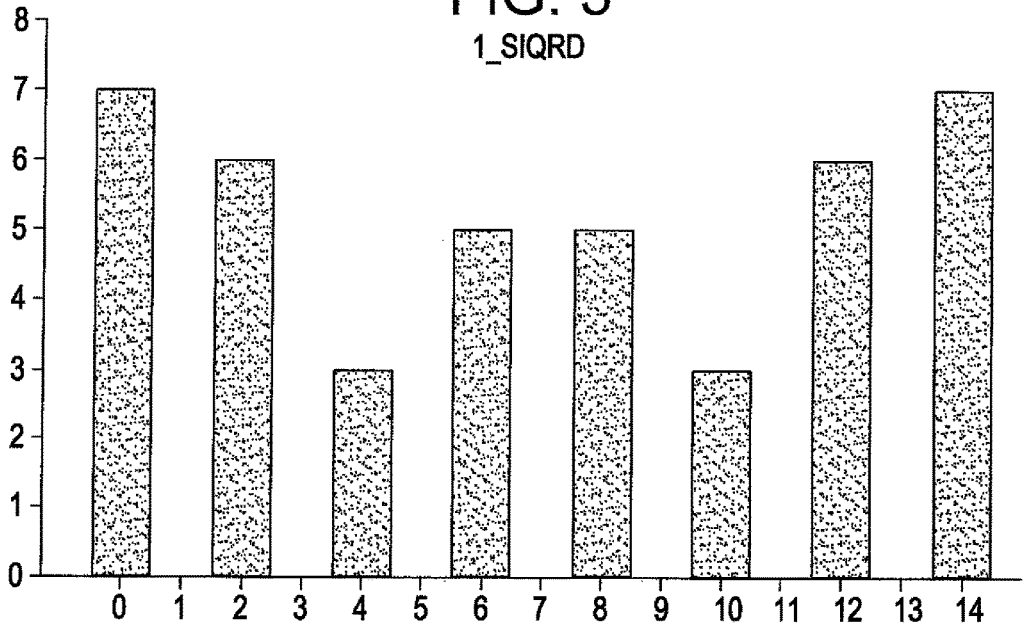
FIG. 3 shows block heights of a diffuser determined by an inverted QRD sequence.
Figure 7:
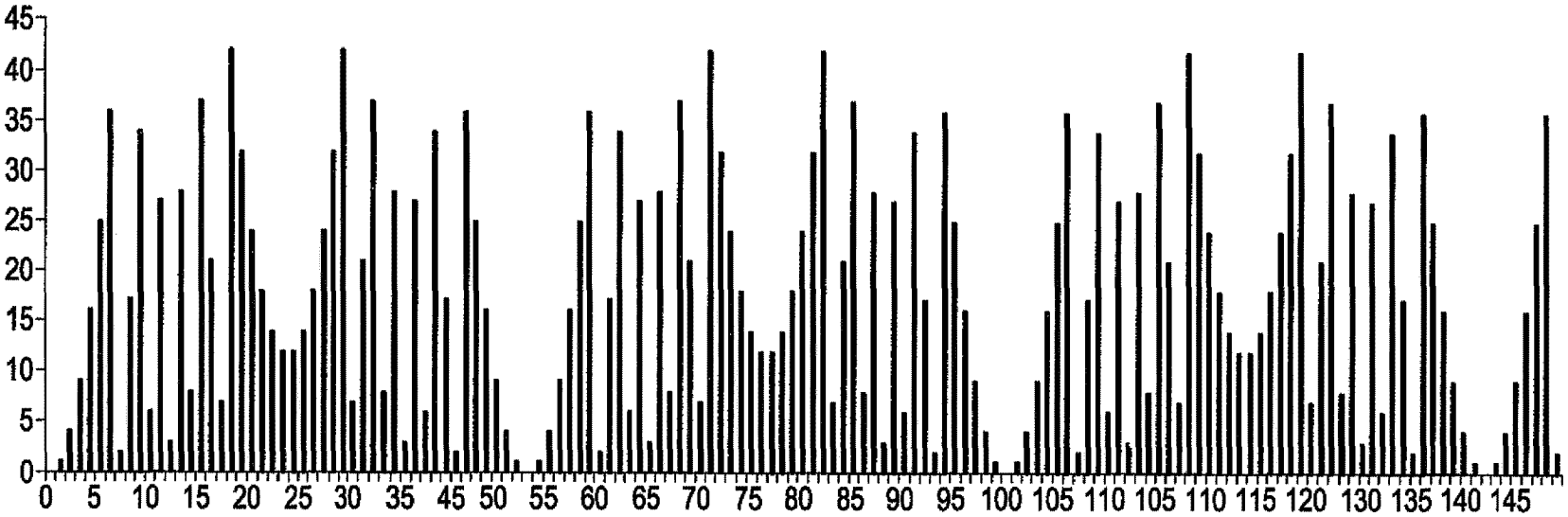
FIG. 7 shows a schematic representation of two repeats of a diffuser-absorber with spaced slats based on a Prime 47, QR sequence. Concave dips in the topology are noted.
Figure 8:
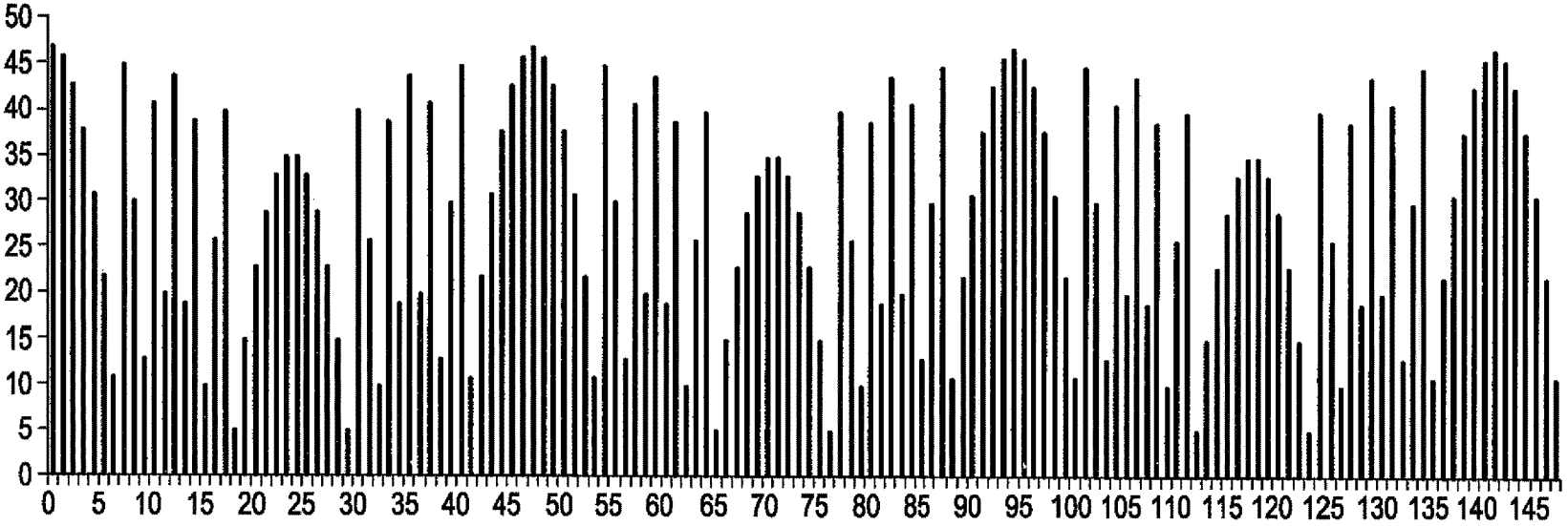
FIG. 8 shows the same diffuser-absorber of FIG. 7, but with the heights based on the inverse QR sequence. The concave areas are now convex and offer improved diffusion in the near field.

FIG. 3 shows a diffuser-absorber in which the block heights are determined, not by the QR sequence, but rather to its inverse. To demonstrate why this is significant and an improvement over the prior art, we present a comparison between the two in a practical implementation, which exhibits a symmetrically aesthetic topology, in FIGS. 7 and 8. In FIG. 7, Applicants illustrate a schematic, side view representation which contains 2 repeats of a diffuser-absorber with spaced slats based on a prime 47, QR sequence. Note the concave dips in the topology at 47 and 94 on the abscissa. Also note smaller concave dips at 24, 72 and 120. While the combined surface provides uniform diffusion in the far field, these concave areas can provide focusing when listeners are closer to the surface. To mitigate this problem, the present invention teaches the use of the inverse series, in which the inverse sequence values are equal to the prime, N, minus the QR sequence values, Sn, i.e. N–Sn. In FIG. 8, Applicants illustrate a diffuser-absorber with heights based on the inverse sequence. It can be seen that the prior concave areas are now convex. These convex areas now contribute to the uniform diffusion of the surface and improve the performance.

Figure 4:
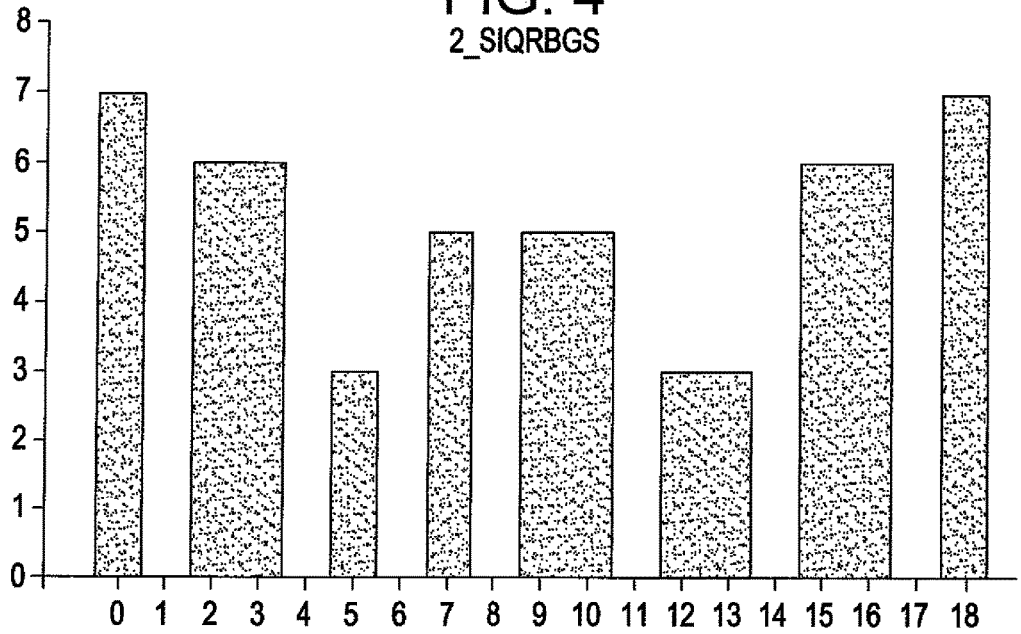
FIG. 4 shows a diffuser with spaced inverted QRD slat heights with widths determined by the ground states of a Bernesconi sequence.

In the second embodiment (FIG. 4), Applicants illustrate a schematic side view representation of a surface whose heights are based on the inverse QR sequence, but now the widths of the slats are no longer equal, but rather based on the ground states of the Bernesconi model with open boundary conditions (J. Phys. A 29 L473 (1996)). The Bernesconi sequence is an optimal, aperiodic binary sequence of zeros and ones. In this case for N=7, the values are 0, 1, 0, 0, 1, 1, 1 with a repeat for the periodic sequence of 0. The slat widths follow this sequence, such that when the slat is a zero it is of a given base width and when the slat is a one it is twice (or some multiple of) the base zero width. The first slat at 0 on the abscissa is a given width and the second slat at 2-3 on the abscissa is twice the width.

Figure 5:
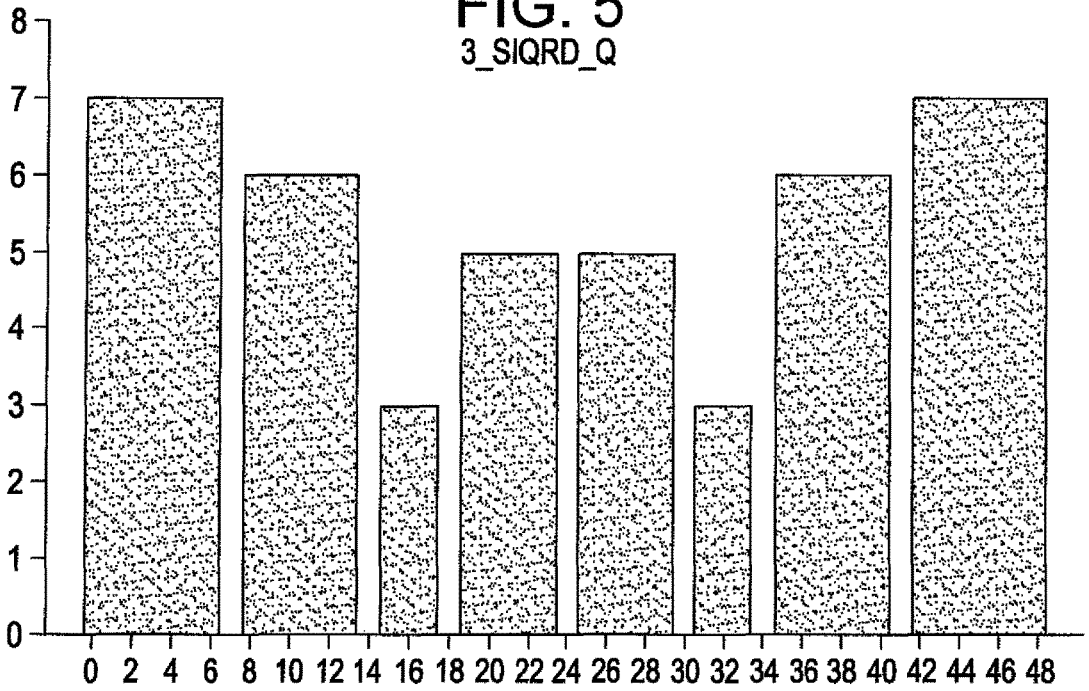
FIG. 5 shows a diffuser with spaced inverted QRD slats with widths determined by the same QRD sequence used to determine the heights.

In the third embodiment (FIG. 5), the widths are based on the same QR sequence used to determine the heights, which is 7, 6, 3, 5, 5, 3, 6 and a repeat 7. Thus, the slat at 0-6 on the abscissa is 7 times the width of a base width slat, the slat at 8-13 is 6 times the base width, etc.

Figure 6:
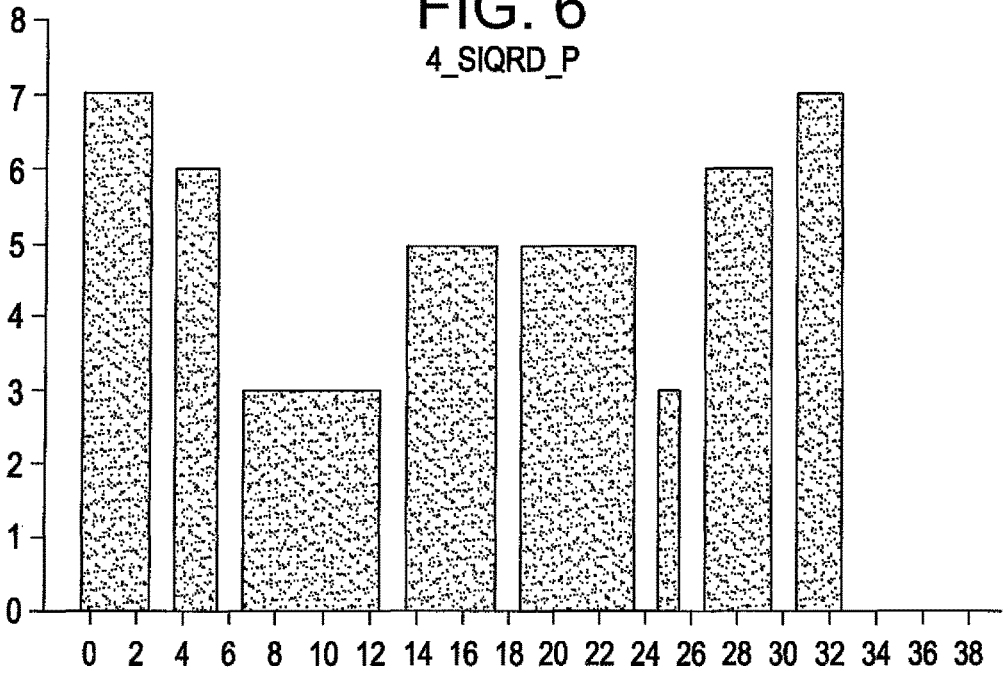
FIG. 6 shows a diffuser with spaced inverted QRD slats with widths determined by a Prime 7, primitive root sequence.

In the fourth embodiment (FIG. 6), the slat widths are determined by a Prime 7, primitive root sequence, whose values are 3, 2, 6, 4, 5, 1 and repeats 3 and 2. Therefore, the first slat has a width of 3 (0-2 on the abscissa), the second slat has a width of 2 (4-5), etc.

The science behind the present invention in its numerous embodiments is as follows. The slat heights can be determined by any number theory sequence, shape optimization or random selection. In the embodiments presented thus far, the heights are determined by a QR sequence:

$Sn=n^2$ modulo N, where Sn is the sequence value of the nth slat, modulo indicates the least non-negative remainder and N is a prime, for example, 7. The relative sequence heights can be seen in the embodiments of FIGS. 3-6, with the sequence values shown on the ordinate. The diffusion design frequency, $f_0$, is given by:

$$f_0=cS_{max}/(2Nh_{max})$$

where c is the speed of sound (13560 in/sec), $S_{max}$ is the maximum sequence value, N is a prime and $h_{max}$ is the maximum slat height. It can be seen, that as the slats get longer the diffusion extends to lower frequency. In practice, effective diffusion occurs roughly an octave or two below this design frequency. With $h_{max}$=4", $S_{max}$=42 and N=47, $f_0$=1515 Hz.

The upper frequency is given by:

$f_{max}$=c/2w, where c is the speed of sound and w is the slat width. Therefore, a 1" wide slat should scatter up to 6,780 Hz, and in practice roughly a half octave above that. This describes the design of the diffusion portion of the surface.

Concerning the slat resonator design, typically slat resonators are formed from equally spaced, equal height and width slats. The absorption design frequency, $f_0$, is given by:

$$f_0=c/2\text{pi}*\text{sqrt}(p/(t'd))$$

where c is the speed of sound, pi=3.14159, sqrt is the square root and p is the fractional open area, t' is the length of the resonator neck formed by the spacing between adjacent slats+0.8*s (which is a rough approximation of the radiation impedance of the resonator neck opening) and d is the depth of the absorbing rear cavity. p=s/(s+w), where s is the slat spacing and w is the width of the slats.

In the present invention, t' is no longer constant, but rather is determined by the length of the constrained area between each adjacent pair of slats. This can be given by:

$$t'_m=h_{max}/N*(\text{if}(S_n>S_{n+1})\text{ then }S_{n+1}\text{ else }Sn)+0.8*s$$

where m is the index of the resonator neck between slat n and slat n+1.

Figure 9:
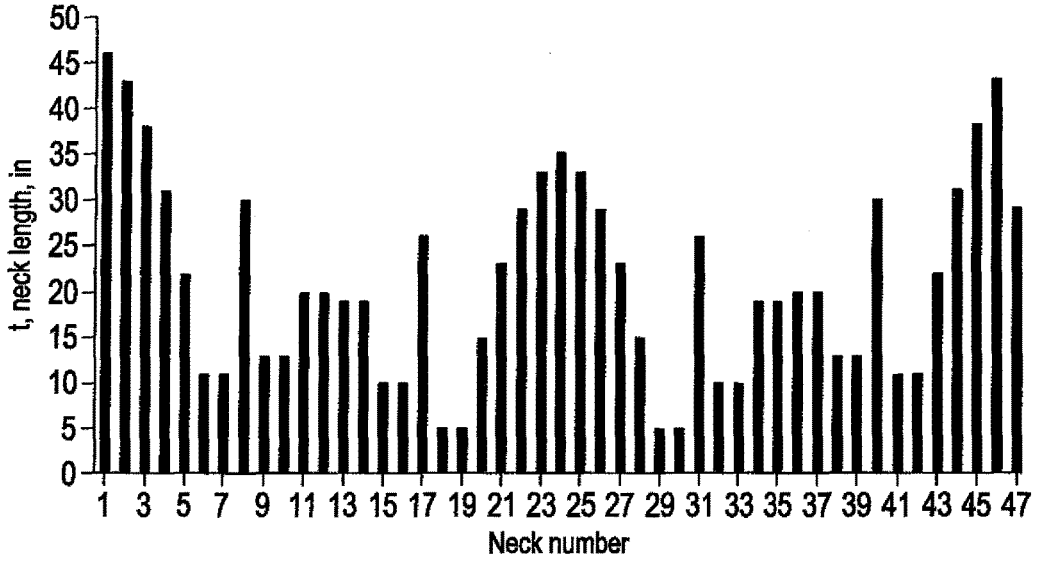
FIG. 9 shows the respective neck lengths formed by a constrained area between adjacent slats.
Figure 10:
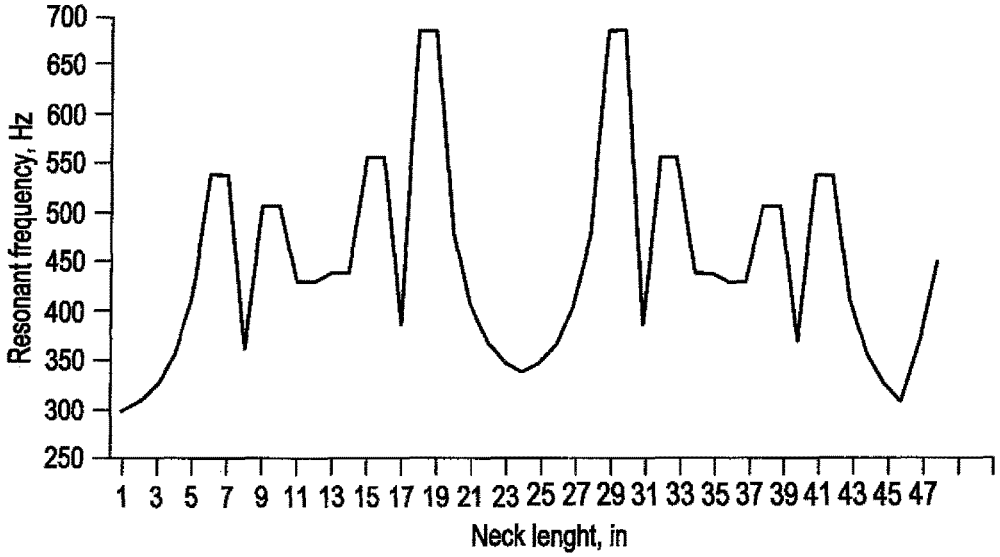
FIG. 10 shows the slat resonator frequency arising from each neck length between adjacent slats, wherein, as shown, the variable neck lengths provide absorption over a beneficial large bandwidth, with an average resonance at 450 Hz.

As an example, for the N=47 QR diffuser in FIG. 7 with $h_{max}$=4", s=0.5", w=1", p=0.33 and a cavity depth d=4", the lengths of the resonator necks are shown in FIG. 9 and the slat resonator frequencies are plotted in FIG. 10. The average resonance is 450 Hz, with a bandwidth of 386 Hz. This is 63% lower than it would be for the non-inverse QR sequence. The bandwidth can be extended by slanting the depth of the rear cavity, which introduces a range in values of d.

Figure 11:
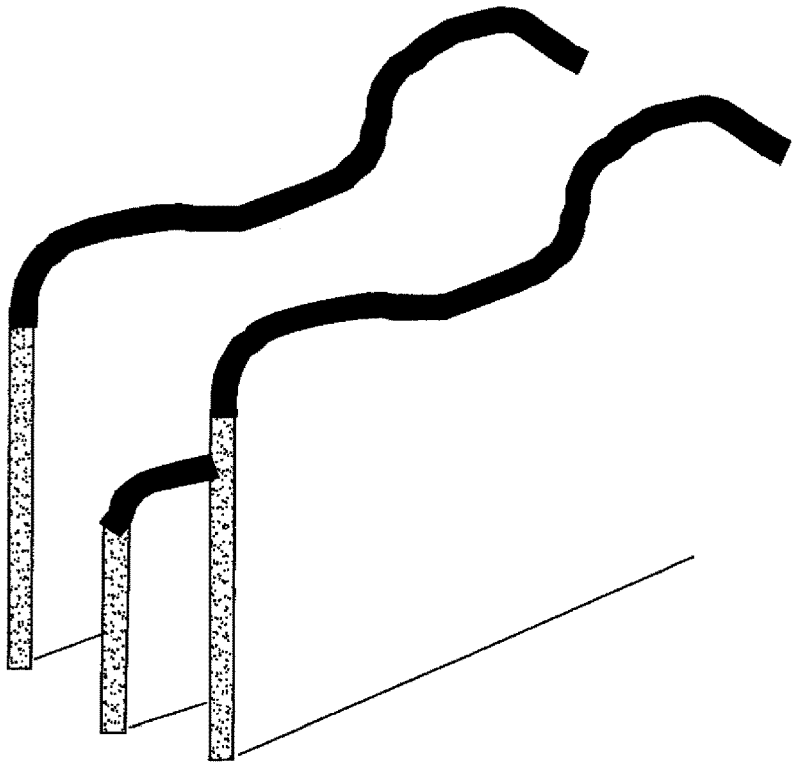
FIGS. 11 and 13 show one of two possible spaced, curvilinear slat options, that replace the rectilinear slats with shape optimized slats, suggesting a surface in which any of the rectilinear slats in FIGS. 3-6 are replaced with an optimized curvilinear slat.
Figure 12:
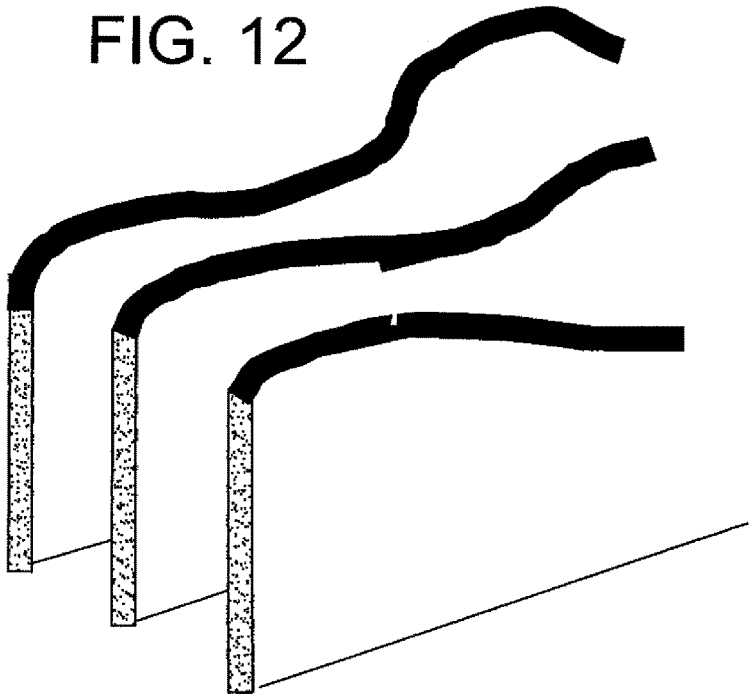
FIGS. 12 and 14 suggest an amorphous surface in which each curvilinear slat forms a part of an optimized 3-dimensional surface.
Figure 13:
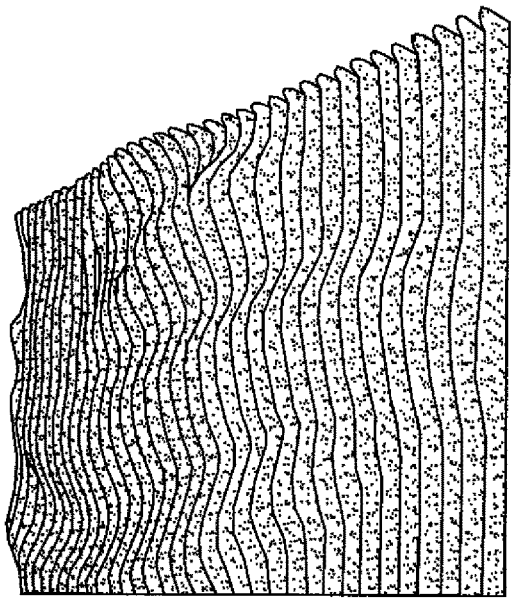
Figure 14:
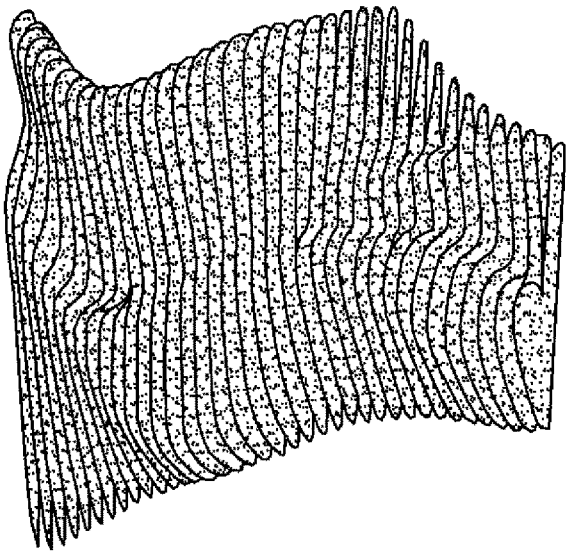

In FIGS. 11-12, Applicants show two additional embodiments which replace the previously described embodiments utilizing rectilinear slats with forward-facing, shape optimized, curvilinear slats. FIG. 11 describes a surface in which any of the rectilinear slats in FIGS. 3-6 are replaced with an optimized curvilinear slat. FIG. 12 describes an optimized, 3-dimensional surface topology formed by spaced, curvilinear slats, which comprise it. FIGS. 13 and 14 show renderings of two possible 3D shapes.

Figure 15:
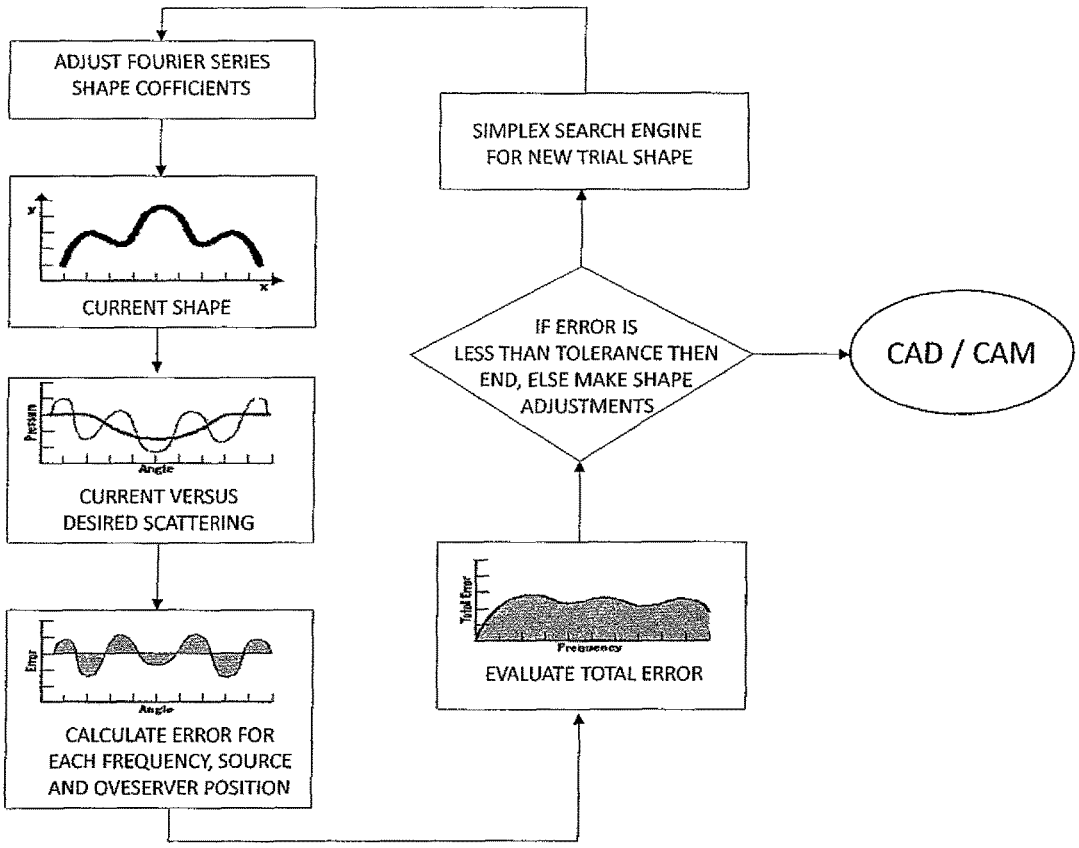
FIG. 15 illustrates the iterative shape optimization software flow diagram.
Figure 17A:
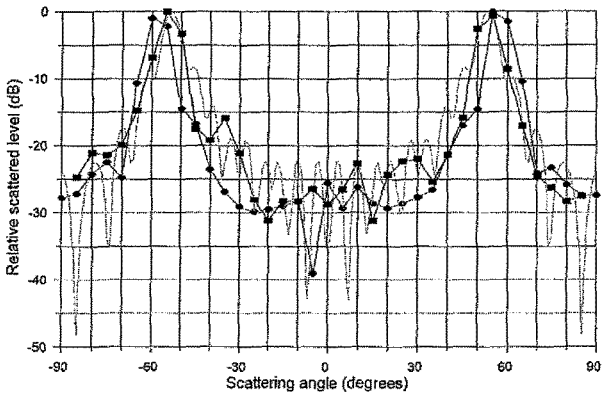
FIGS. 17*a-c* describe the Boundary Element Method (BEM) formula used to predict the scattered pressure (FIG. 17*a*), the diffusion coefficient that is used as an optimization metric (FIG. 17*b*), and the intelligent search engine used to navigate error space (FIG. 17*c*).
Figure 17B:
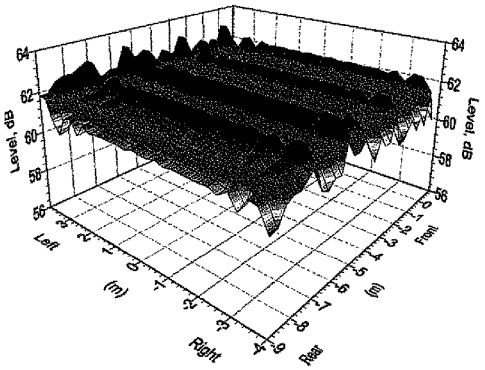
Figure 17C:
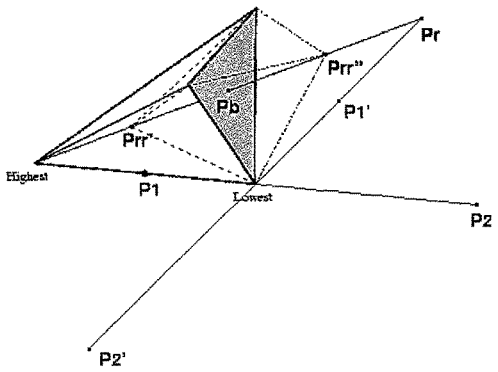

In FIG. 15, Applicants show an iterative software flow chart used to obtain a desired optimized curvilinear slat or surface. We start with a given motif described by Fourier series shape coefficients. The angular scattering is calculated using a boundary element program, whose formula is shown in FIG. 17*a*. The polar response or the diffusion coefficient, shown in FIG. 17*b* at each frequency is compared with the desired values. If the agreement is acceptable, the program ends. If not acceptable, a downhill simples or genetic algorithm, shown in FIG. 17*c* is used to suggest the next possible shape to evaluate. This iteration proceeds until a satisfactory shape is produced.

Figure 16:
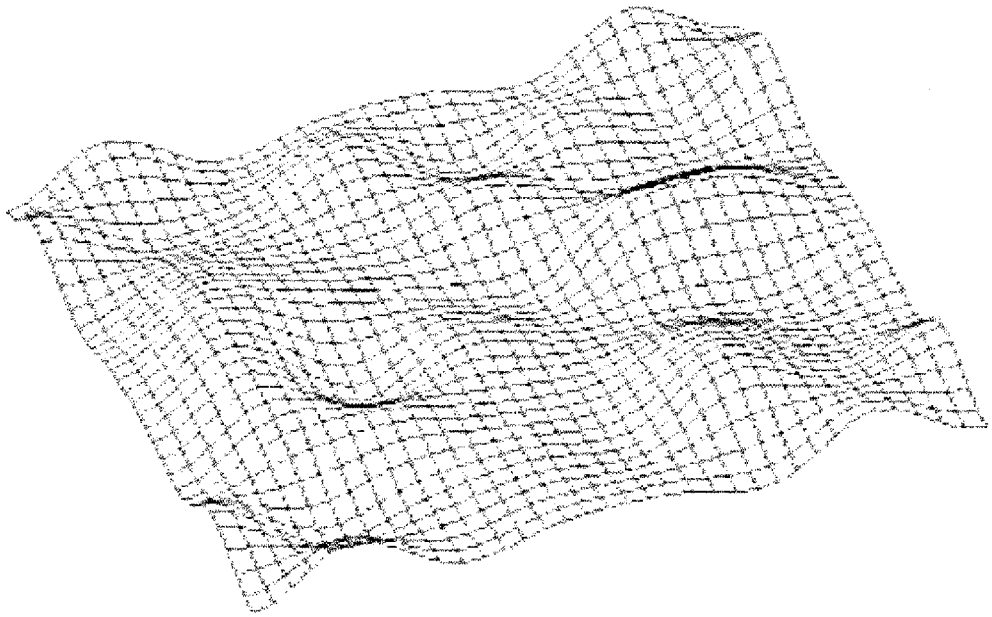
FIG. 16 shows an example of a 3-dimensional topology which can be sliced into a series of spaced, forward facing curvilinear slats.

FIG. 16 illustrates an example of a 3-dimensional topography which can be sliced into a series of spaced, forward facing curvilinear slats.

Accordingly, an invention has been disclosed in terms of preferred embodiments that fulfill each and every one of the objects of the invention as set forth hereinabove, and provide new and useful combined diffuser-absorber with well-dividing slats of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. A combined sound diffuser-sound absorber comprising:

a) a plurality of slats, each slat having a first end and a second forward facing end having a forward facing surface;

b) said slats lying in parallel planes and being equally spaced from one another;

c) respective ones of said slats having heights determined through calculation of an inverted QR sequence, and as a result of inverting said QR sequence, said heights of said slats defining convex areas contributing to uniform diffusion of sound; and d) a sound absorbing material located adjacent said first ends of said slats.

2. The combined sound diffuser-sound absorber of claim 1, wherein said forward facing surfaces are flat.

3. The combined sound diffuser-sound absorber of claim 1, wherein said forward facing surfaces are curvilinear.

4. The combined sound diffuser-sound absorber of claim 1, wherein said slats have equal widths.

5. The combined sound diffuser-sound absorber of claim 1, wherein said slats have differing widths, said widths being determined by calculation of ground states of a Bernesconi sequence.

6. The combined sound diffuser-sound absorber of claim 2, wherein said slats have differing widths determined through calculation of a Prime 7 primitive root sequence.

7. The combined sound diffuser-sound absorber of claim 2, wherein said slats have differing widths determined through calculation of an inverted QR sequence.

8. The combined sound diffuser-sound absorber of claim 3, wherein shapes of said curvilinear surfaces are determined through determination of Fourier series shape coefficients.

9. The combined sound diffuser-sound absorber of claim 4, wherein said forward facing surfaces are flat.

10. The combined sound diffuser-sound absorber of claim 5, wherein said forward facing surfaces are flat.

11. The combined sound diffuser-sound absorber of claim 6, wherein said forward facing surfaces are flat.

12. A combined sound diffuser-sound absorber comprising:

a) a plurality of slats, each slat having a first end and a second forward facing end having a forward facing surface;

b) said slats lying in parallel planes and being equally spaced from one another, each of said slats having a thickness in a direction perpendicular to said parallel planes;

c) respective ones of said slats having heights determined through calculation of a sequence chosen from the group consisting of a regular QR sequence, an inverted QR sequence, a primitive root sequence, and an optimized sequence;

d) said forward facing surfaces being curvilinear in a direction aligned with said parallel planes; and e) a sound absorbing material located adjacent said first ends of said slats.

13. The combined sound diffuser-sound absorber of claim 12, wherein said slats have equal thicknesses.

14. The combined sound diffuser-sound absorber of claim 12, wherein said slats have differing thicknesses determined through calculation of a sequence chosen from the group consisting of ground states of a Bernesconi sequence, a Prime 7 primitive root sequence, and an inverted QR sequence.

15. The combined sound diffuser-sound absorber of claim 14, wherein said sequence comprises ground states of a Bernesconi sequence.

16. The combined sound diffuser-sound absorber of claim 14, wherein said sequence comprises a Prime 7 primitive root sequence.

17. The combined sound diffuser-sound absorber of claim 14, wherein said sequence comprises an inverted QR sequence.

* * * * *